United States Patent [19]

Keihm

[11] 4,280,638

[45] Jul. 28, 1981

[54] FLUID DISPENSING APPARATUS

[75] Inventor: Neil W. Keihm, Newark, Del.

[73] Assignee: ICI Americas Inc., Wilmington, Del.

[21] Appl. No.: 87,234

[22] Filed: Oct. 22, 1979

[51] Int. Cl.[3] ..... B67D 47/34

[52] U.S. Cl. ..... 222/180; 222/325; 248/312

[58] Field of Search ..... 222/325, 180, 181, 173; 248/311.3, 312, 311.2; 211/76

[56] References Cited

U.S. PATENT DOCUMENTS

| | | | |
|---|---|---|---|
| 7,318 | 4/1850 | Brown . | |
| 322,286 | 7/1855 | Hemje | 285/85 |
| 737,638 | 9/1903 | Lazareff . | |
| 739,624 | 9/1903 | Traver . | |
| 1,229,556 | 6/1917 | Watrous | 222/325 X |
| 1,647,245 | 11/1927 | Morrill | 222/181 |
| 1,924,704 | 8/1933 | Bartholomew | 222/325 X |
| 2,081,798 | 5/1937 | Dinneen | 222/321 |
| 2,149,681 | 3/1939 | Johnston | 284/19 |
| 2,407,765 | 5/1945 | Palmer | 222/340 |
| 2,628,744 | 2/1953 | Mowbray | 222/179 |
| 2,841,311 | 7/1958 | Parizek | 222/181 |
| 3,100,655 | 8/1963 | Work | 285/33 |
| 3,237,809 | 3/1966 | Daragan et al. | 222/135 |
| 3,349,967 | 10/1967 | Schneller | 222/130 |
| 3,716,161 | 2/1973 | Julian | 215/9 |
| 3,912,125 | 10/1975 | Acklin | 222/181 X |
| 4,060,105 | 11/1977 | Feldeisen et al. | 222/325 X |

FOREIGN PATENT DOCUMENTS

| | | | |
|---|---|---|---|
| 701809 | 1/1954 | United Kingdom | 222/181 |
| 811596 | 4/1959 | United Kingdom | 222/181 |

*Primary Examiner*—Robert J. Spar
*Assistant Examiner*—Frederick R. Handren

[57] ABSTRACT

An apparatus for dispensing a fluid comprising (a) a container having a globe portion, a neck portion the top part of which is externally threaded, and lug means on the neck portion below said threaded neck portion and above the globe portion, (b) a rack having anchoring means for attachment to an upright surface and receiving lug means to interlock with lug means of the container and (c) a pump assembly having a delivery end, a pump portion and a dip tube connected with and through an internally threaded cap, so as to provide for insertion of the dip tube into the lower portion of the globe, threaded engagement of the cap with the threaded portion of the container and interlocking of the container lug means with the rack receiving lug means to form a unitary structure.

4 Claims, 7 Drawing Figures

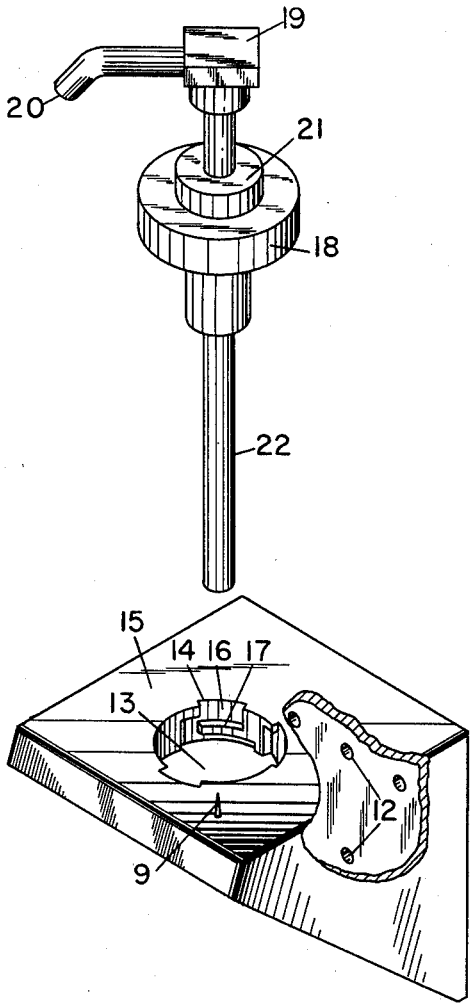
FIG. 7
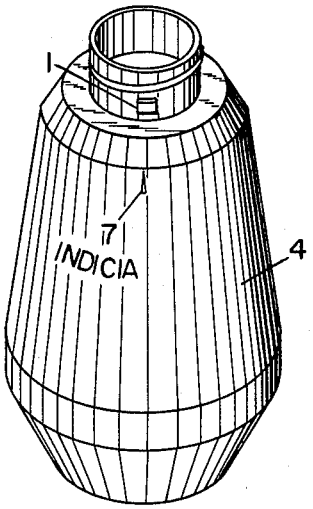

FLUID DISPENSING APPARATUS

This invention relates to apparatus for dispensing a fluid. More particularly it relates to a novel container with pump means and an anchoring rack.

The present apparatus is especially adapted, though not exclusively, for dispensing liquid antimicrobial agents, liquid soap and the like.

There are many fluid dispensers on the market and described in the art which are composed of a rack, bottle and pump means; however, the present invention provides such a combination wherein nornal bottles with screw tops cannot be used.

It is an object of the present invention to provide a fluid dispenser that is easily and quickly installed for use.

Another object of the present invention is to provide a liquid antimicrobial dispenser wherein the rack to hold and anchor the container or bottle containing the antimicrobial agent is constructed in such a manner so that it will not accommodate or hold a bottle provided only with the normal external top screw thread.

A further object of the present invention is to provide a container or bottle that can be used in combination with the present rack or racks already on the market that are used for dispensing antimicrobial agents.

These and other objects of the subject invention are obtained by the present apparatus comprised of (a) a container having a globe portion, a neck portion the top part of which is externally threaded, and lug means on the neck portion below said threaded neck portion and above the globe portion, (b) a rack having anchoring means for attachment to an upright surface and receiving lug means to interlock with lug means of the container and (c) a pump assembly having a delivery end, a pump portion and a dip tube connected with and through an internally threaded cap, so as to provide for insertion of the dip tube into the lower portion of the globe, threaded engagement of the cap with the threaded portion of the container and interlocking of the container lug means with the rack receiving lug means to form a unitary structure.

The objects of the present invention, and others, will be apparent from the following description of the present invention taken in connection with the accompanying drawings:

FIG. 7 is an exploded perspective view of the dispensing apparatus of the present invention.

Figure 1:
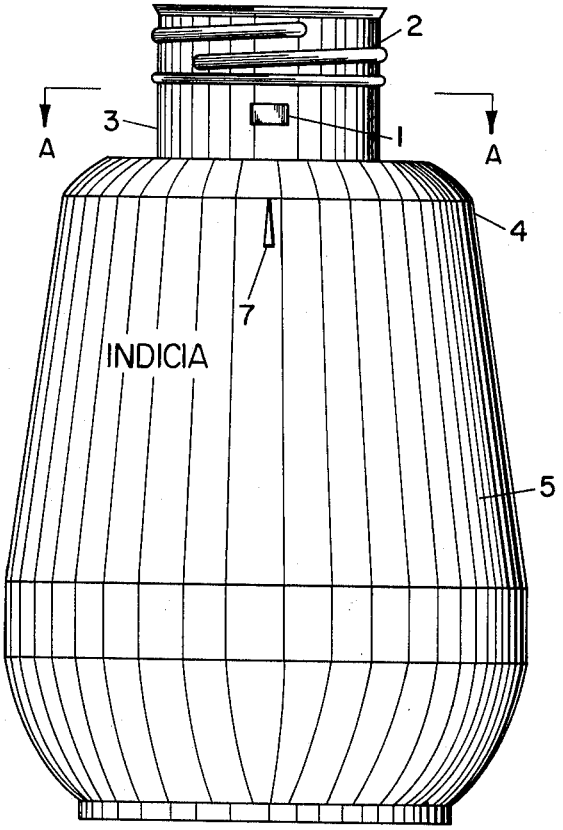
FIG. 1 is a front elevation of the container of the present invention.
Figure 4:
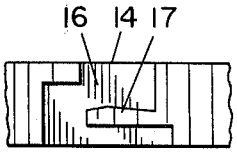
FIG. 4 is a sectional view taken along the lines B—B of FIG. 3.

Referring to drawings in which like numerals are employed to designate like parts throughout, a container of the present invention is shown in FIG. 1 wherein 1 is a lug and 2 is a screw thread about the external neck 3 of the container designated 4. The portion of the container below the neck 3 is globe 5.

Figure 2:
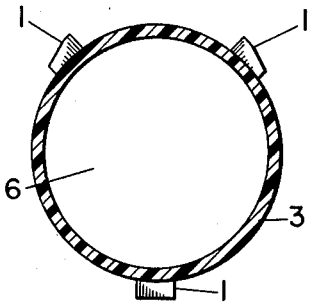
FIG. 2 is a sectional view taken along the lines A—A of FIG. 1.
Figure 3:
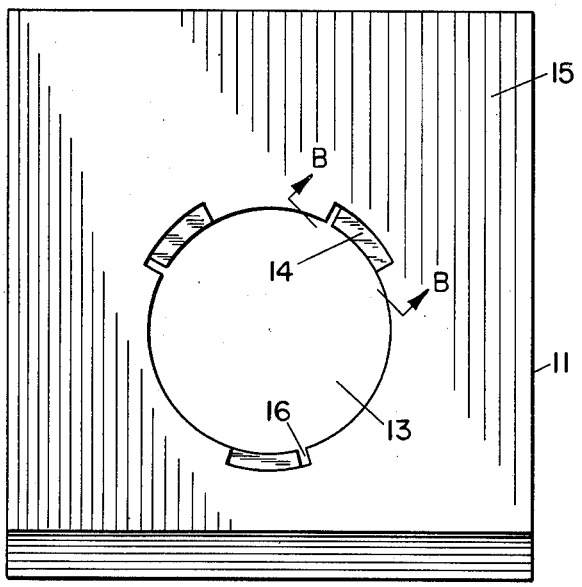
FIG. 3 is a top plan view of the rack of the present invention.

In FIG. 2 the three lugs 1 are suitably placed around neck 3. Container 4 has an opening 6 at the top of the container. In FIGS. 3 and 7 numeral 11 refers to the rack or bracket having anchoring means or aperatures 12 to provide for anchoring rack 11 to an upright surface such as a wall. Rack 11 is provided with an opening 13 around which is suitably placed receiving lug means designated generally 14. In FIGS. 3 and 7 it will be seen that three receiving lug means 14 are suitably placed around the inner face of opening 13 of rack 11.

Figure 5:
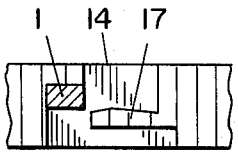
FIG. 5 is a plan view taken along the lines B—B of FIG. 3 showing the position of lug 1 in cross section prior to being placed in the locked position.
Figure 6:
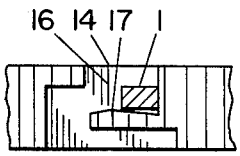
FIG. 6 is a plan view taken along the lines B—B of FIG. 3 showing the position of lug 1 in cross section after being placed in the locked position.

As shown in FIGS. 3–7 receiving lug means 14 is comprised of recess 16 formed to create locking or ramp means 17. Each ramp 17 is constructed to receive one lug 1. In FIG. 5 is shown the position of a lug 1 before being locked into place on ramp 17 in receiving lug means 14. In FIG. 6 a lug 1 is shown in locked position on ramp 17 in receiving lug means 14.

In FIGS. 2 and 7 three lug means 1 and receiving lug means 14 are suggested. Such three lug means 1 are spaced about the rack of container 4 so that two of the lug means 1 are closer to each other than to the third lug 1. In a preferred embodiment two of the lug means 1 are each located about 135° from the third lug means 1 and the said two lug means 1 are located about 90° from each other.

In the process of using the present apparatus the arrow or mark 7 on bottle 4 is lined up with the mark or arrow 9 on rack 11 and the neck 3 of bottle 4 is inserted into opening 13 and then turned clockwise so as to result in bottle 4 being locked into rack 11 by lugs 1 with the screw thread 2 of bottle 4 operatively extending above the top surface 15 of rack 11: Dip tube 22 of pump assembly 21 can then be inserted down into container 4 and the internally threaded collar 18 of pump 21 can be screwed into into threaded engagement with the external screw thread 2 of bottle 4 by turning the collar 18 clockwise so as to form a unitary structure between container 4, rack 11 and pump assembly 21.

The lug means 1, receiving lug means 14, arrow 7, arrow 9 and the indicia are appropriately placed so that when bottle 4 is locked into rack 11, which is suitably anchored on an upright surface, the indicia will be centered in front when observed by a person facing the upright surface.

When constructed and arranged as indicated above, the present fluid delivery apparatus will operate in the following manner: When downward pressure is applied against the top 19 of pump assembly 21, so as to depress the pump, a portion of the fluid contained in container 4 is delivered from the delivery end 20 of pump assembly 21.

In a preferred embodiment of the present invention lugs 1 extend out approximately one-eighth inch ($\frac{1}{8}$") from neck 3 of container 4 and are about one-eighth inch ($\frac{1}{8}$") in height and one-quarter inch ($\frac{1}{4}$") long or wide. However, lugs 1 can have any suitable functional shape, for example as shown in FIGS. 1 and 2, including rectangular and triangular. The top of lugs 1 in this preferred embodiment are about three-eighths inch ($\frac{3}{8}$") below the lowest thread of external screw thread 2 on neck 3. Container 4 can be any suitable size but preferably is one having a capacity of 4, 8, 16, 32 or up to 128 fluid ounces. A preferred container 4 having a 16 ounce fluid ounce capacity would have a neck 3 having an outside diameter of about one and one-half inches ($1\frac{1}{2}$") and an opening 6 of about one and three-eighths inches ($1\frac{3}{8}$") in diameter. Ramps 17 of this preferred embodiment would have a suitably shaped height between about 0.030 inches and 0.050 inches so as to provide for the tight seating or locking of lugs 1 on ramp 17. Ramps 17 are about seventh-sixteenths of an inch (7/16") in length and extend out from the face of recess 16 about one-eighth inch ($1\frac{1}{8}$"). The length of recess 14 in the top of rack 11 as shown in FIGS. 3 to 7 is about one-half inch ($\frac{1}{2}$") long. In this preferred embodiment from the entry position when mark 7 on container 4 is lined up with mark 9 on rack 11 container 4 need only be turned one-eighth inch of a turn to place it in the locked position.

All parts of the present apparatus can be prepared from or made from any suitable material. For example, rack 11 can be made of plastic or ceramic material. Any suitable plastic can be used such as polystyrene, polyvinylchloride or polypropylene. Container 4 can be made from any suitable plastic material, such as polypropylene, polyethylene or polyvinylchloride or may be made of glass. Hand pump 21 similarly can be made from any suitable materials, such as plastic or metal. Suitable plastics include polystyrene ad polyvinylchloride. A pump assembly 21 suitable for use in the present assembly is commercially available from Bakan Plastics, Kansas City, Mo.

What is claimed is:

1. An apparatus for dispensing a fluid comprising (a) a container having a globe portion, a neck portion the top part of which is externally threaded, and three lugs spaced around the neck portion below said threaded neck portion and above the globe portion so that two lugs are closer to each other than to the third lug, (b) a rack having anchoring means for attachment to an upright surface and three lug receiving means to interlock with the three lugs on the container and (c) a pump assembly having a delivery end, a pump portion and a dip tube connected with and through an internally threaded cap, so as to provide for insertion of the dip tube into the lower portion of the globe, threaded engagement of the cap with the threaded portion of the container and interlocking of the three lugs on the container with the three lug receiving means on the rack to form a unitary structure.

2. An apparatus of claim 1 wherein the lugs are comprised of three projections, two of which are located about 135° from one projection and the two said projections being located about 90° from each other.

3. An apparatus of claim 2 wherein the lug means extend approximately $\frac{1}{8}$" out from the neck of the container.

4. An apparatus of claim 3 wherein the container and rack are made of plastic.

* * * * *